US008139077B2

(12) United States Patent
Beaumont

(10) Patent No.: US 8,139,077 B2
(45) Date of Patent: Mar. 20, 2012

(54) ENHANCED ALPHA BLENDING

(75) Inventor: Cyril Beaumont, La Colle sur Loup (FR)

(73) Assignee: Texas Instruments Incorporated, Dallas, TX (US)

( * ) Notice: Subject to any disclaimer, the term of this patent is extended or adjusted under 35 U.S.C. 154(b) by 1053 days.

(21) Appl. No.: 11/960,386

(22) Filed: Dec. 19, 2007

(65) Prior Publication Data

US 2009/0115793 A1 May 7, 2009

(30) Foreign Application Priority Data

Nov. 2, 2007 (EP) ..... 07291316

(51) Int. Cl.
*G09G 5/02* (2006.01)

(52) U.S. Cl. ..... 345/589; 345/592

(58) Field of Classification Search ..... 345/589–592
See application file for complete search history.

(56) References Cited

U.S. PATENT DOCUMENTS 6,018,353 A * 1/2000 Deering et al. ..... 345/537
6,144,365 A * 11/2000 Young et al. ..... 345/600
6,329,999 B1 * 12/2001 Mitsushita et al. ..... 345/582
6,981,227 B1 * 12/2005 Taylor ..... 715/768
7,940,280 B2 * 5/2011 Sellers et al. ..... 345/589
2004/0160456 A1 * 8/2004 Steele et al. ..... 345/612
2007/0057972 A1 * 3/2007 Krasnopolsky ..... 345/629

OTHER PUBLICATIONS

Lionhead Studios, Forum, http://lionhead.com/forums/t/16922.aspx, Apr. 2001.*

Hearn et al., Computer Graphics with OpenGL, Prentice Hall, 3rd Edition, Aug. 2003.*

* cited by examiner

*Primary Examiner* — Xiao M. Wu
*Assistant Examiner* — Charles Tseng
(74) *Attorney, Agent, or Firm* — Alan A. R. Cooper; Wade James Brady, III; Frederick J. Telecky, Jr.

(57) ABSTRACT

A system including storage comprising a first graphical pixel and a second graphical pixel. Each of the first and second graphical pixels is associated with binary codes having red, green and blue sub-codes. The system also comprises processing logic coupled to the storage and adapted to alpha-blend the first and second graphical pixels to produce a blended pixel. The processing logic performs this alpha-blend using the binary codes having red, green and blue sub-codes in concatenated form and without operating on the sub-codes individually. The processing logic displays the blended pixel.

20 Claims, 6 Drawing Sheets

```
502 Loop for rows                                  504                    500
    {
        Loop for columns
        {
            Extract RGB data from pixel of first image      } 506
            Extract RGB data from pixel of second image     } 508
            Add R data and shift sum                        } 510
            Add G data and shift sum                        } 512      } 505
            Add B data and shift sum                        } 514
            Concatenate shifted sums and write to first image } 516
        }
        Adjust pointers } 518
    }
```

*FIG. 5A*

```
for (ICnt1 = 0; ICnt1 < HEIGHT; ICnt1++)                                  550
{           for (ICnt2 = 0; ICnt2 < WIDTH; ICnt2++)                       552
            {
                    Rdst = Image 206 [ICnt2]&t 0xF800)>>11;               554
                    Gdst = Image 206 [ICnt2] &t 0x07E0);                  556
                    Bdst = Image 206 [ICnt2]&t 0x001F);                   558

                    Rbld = Image 208 [ICnt2]&t 0xF800)>>11;               560
210                 Gbld = Image 208 [ICnt2] &t 0x07E0);                  562
                    Bbld = Image 208 [ICnt2]&t 0x001F);                   564

                    Rdst = ((Rbld + Rdst) >> 1);                          566
                    Gdst = ((Gbld + Gdst) >> 1);                          568
                    Bdst = ((Bbld + Bdst) >> 1);                          570

                    Image 206 [ICnt2] = (Rdst << 11);                     572
                    Image 206 [ICnt2] + = (Gdst << 5);                    574
                    Image 206 [ICnt2] + = Bdst;                           576
            }
        Image 208 + = WIDTH;                                              578
        Image 206 + = WIDTH;                                              580
        }
```

*FIG. 5B*

```
                                                        600
Loop for rows 602
{
    Loop for columns 604
    {
1st image pixel = ((2nd image pixel >>1) & mask) 610
                +((1st image pixel >>1) & mask) 612
                    +((((2nd image pixel & mask) 614
                +(1st image pixel & mask)) >>1) 618
                                616   617
    }                                   & mask) 620
    Adjust pointers 608
}
```

606

*FIG. 6A*

```
                                                        700
Loop for rows 702
{
    Loop for double columns 704
    {
1st image pixel = (2nd image pixel >>1) & double mask) 710
                +(1st image pixel >>1) & double mask) 712
                    +((((2nd image pixel & double mask) 714
                +(1st image pixel & double mask)) >>1) 718
                                716   717
    }                                   & double mask) 720
    Adjust pointers 708
}
```

706

*FIG. 7A*

```
for (ICnt1 = 0; ICnt1 < HEIGHT; ICnt1++)  650
{
        for (ICnt2 = 0; ICnt2 < WIDTH; ICnt2++)  652
        {
                Image 206 [ICnt2] = ((Image 208 [ICnt2] >>1) & 0x7BEF) + ((Image 206 [ICnt2] >>1) & 0x7BEF)
                    +(((( Image 208 [ICnt2] & 0x0821) + (Image 206 [ICnt2] & 0x0821)) >> 1) & 0x0821);
                }
        Image 208 + = WIDTH;  656
        Image 206 + = WIDTH;  658
        }
```

210 660 662 654 664 666 667 668 670

*FIG. 6B*

```
for (ICnt1 = 0; ICnt1 < HEIGHT; ICnt1++)  750
{
        for (ICnt2 = 0; ICnt2 < (WIDTH/2); ICnt2++)  752
        {
                Image 206 [ICnt2] = ((Image 208 [ICnt2] >>1) & 0x7BEF7BEF) + ((Image 206 [ICnt2] >>1) & 0x7BEF7BEF)
                    +(((( Image 208 [ICnt2] & 0x08210821) + (Image 206 [ICnt2] & 0x08210821)) >> 1) & 0x08210821);
                }
        IB + = (WIDTH/2);  756
        ID + = (WIDTH/2);  758
}
```

210 760 762 754 764 766 767 768 770

*FIG. 7B*

ENHANCED ALPHA BLENDING

CROSS-REFERENCE TO RELATED APPLICATION

The present application claims priority to EP Application No. 07291316.3, filed on Nov. 2, 2007, hereby incorporated herein by reference.

BACKGROUND

Graphical images (e.g., JPEG images) comprise a plurality of pixels. In "alpha" blending, the pixels of multiple images are blended together to create the graphical effect of translucency. For example, the pixels of a foreground image may be alpha-blended with the pixels of a background image, so that the foreground image is made to appear "translucent" and the background image is visible through the foreground image. Various graphical effects, such as "fading," may be achieved using alpha-blending. However, alpha-blending is a computationally expensive process that consumes an undesirably large number of processor clock cycles.

SUMMARY

Accordingly, there are disclosed herein a computationally-inexpensive technique by which pixels of multiple images may be alpha-blended. An illustrative embodiment comprises a system including storage comprising a first graphical pixel and a second graphical pixel. Each of the first and second graphical pixels is associated with binary codes having red, green and blue sub-codes. The system also comprises processing logic coupled to the storage and adapted to alpha-blend the first and second graphical pixels to produce a blended pixel. The processing logic performs this alpha-blend using the binary codes having red, green and blue sub-codes in concatenated form and without operating on the sub-codes individually. The processing logic displays the blended pixel.

Another illustrative embodiment comprises a computer-readable medium containing software that, when executed by a processor, causes the processor to obtain a first binary code associated with a first graphical pixel and a second binary code associated with a second graphical pixel. Each of the binary codes comprises multiple sub-codes. The processor is also caused to alpha-blend the first and second binary codes to produce a third binary code, where the alpha-blend is performed without individually alpha-blending sub-codes that correspond to each other. The processor is further caused to store the third binary code.

Yet another illustrative embodiment includes a method that comprises obtaining a first binary code and a second binary code, where each of the binary codes comprises sub-codes associated with different colors. Each of the sub-codes corresponds to another one of the sub-codes. The method also comprises alpha-blending the first and second binary codes to produce a resulting binary code, where the alpha-blending is performed without operating individually on pairs of sub-codes which correspond to each other. The method further comprises overwriting at least one of the first and second binary codes with the resulting binary code.

BRIEF DESCRIPTION OF THE DRAWINGS

For a detailed description of exemplary embodiments of the invention, reference will now be made to the accompanying drawings in which:

FIG. 5*a* shows pseudocode of an alpha-blending algorithm;

FIG. 5*b* shows software code associated with the pseudocode of FIG. 5*a;*

FIG. 6*a* shows pseudocode of another algorithm associated with at least some preferred embodiments of the invention;

FIG. 6*b* shows software code associated with the pseudocode of FIG. 6*a*, in accordance with preferred embodiments of the invention;

FIG. 7*a* shows pseudocode of yet another algorithm associated with at least some preferred embodiments of the invention;

FIG. 7*b* shows software code associated with the pseudocode of FIG. 7*a*, in accordance with preferred embodiments of the invention.

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . " Also, the term "couple" or "couples" is intended to mean either an indirect or direct electrical connection. Thus, if a first device couples to a second device, that connection may be through a direct electrical connection, or through an indirect electrical connection via other devices and connections. The term "connection" refers to any path via which a signal may pass. For example, the term "connection" includes, without limitation, wires, traces and other types of electrical conductors, optical devices, etc.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
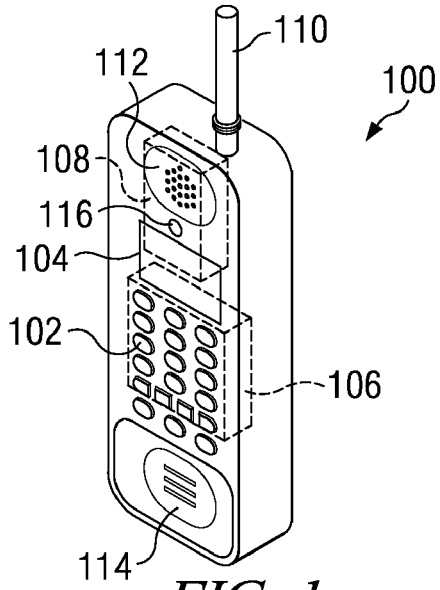
FIG. 1 shows an illustrative mobile communication device implementing the techniques disclosed herein in accordance with embodiments of the invention.

Disclosed herein are various embodiments of a computationally-inexpensive technique by which pixels of multiple images may be alpha-blended. FIG. 1 shows an illustrative mobile communication device 100 (e.g., a cell phone) implementing at least some of these techniques. The device 100 comprises a battery-operated apparatus which includes an integrated keypad 102, display 104 and radio frequency ("RF") circuitry 108. The display 104 may comprise any suitable display, such as a liquid crystal display (LCD). The device 100 also includes an electronics package 106 coupled to the keypad 102, display 104 and radio frequency ("RF") circuitry 108. The electronics package 106 contains various electronic components used by the device 100, including processing logic, storage logic, one or more batteries, etc. The device 100 also comprises a speaker 112, used to output audible signals, and a microphone 114, used to receive audible signals.

The device 100 further includes an imaging device or sensor (e.g., a camera) 116 which may be used to capture digital images (i.e., photographs) and/or video. The sensor 116 couples to a lens (also represented as numeral 116) and is considered to be part of a camera module (not specifically shown) housed within the device 100. The RF circuitry 108 may couple to an antenna 110 by which data transmissions are sent and received. Although the mobile communication device 100 is represented as a mobile phone in FIG. 1, the scope of this disclosure is not limited to mobile phones and also may include personal digital assistants (e.g., BLACKBERRY® or PALM® devices), multi-purpose audio devices (e.g., APPLE® iPHONE® devices), portable computers or any other suitable electronic device(s). In other embodiments, the device is not battery-operated and/or not portable. In some embodiments, the device 100 is a digital camera or a smart camera (e.g., used in video surveillance) instead of a mobile communication device. The device 100 may be a personal computer (PC). The contents of the electronics package 106, which implement techniques in accordance with embodiments of the invention, are now described in detail with reference to FIG. 2.

Figure 2:
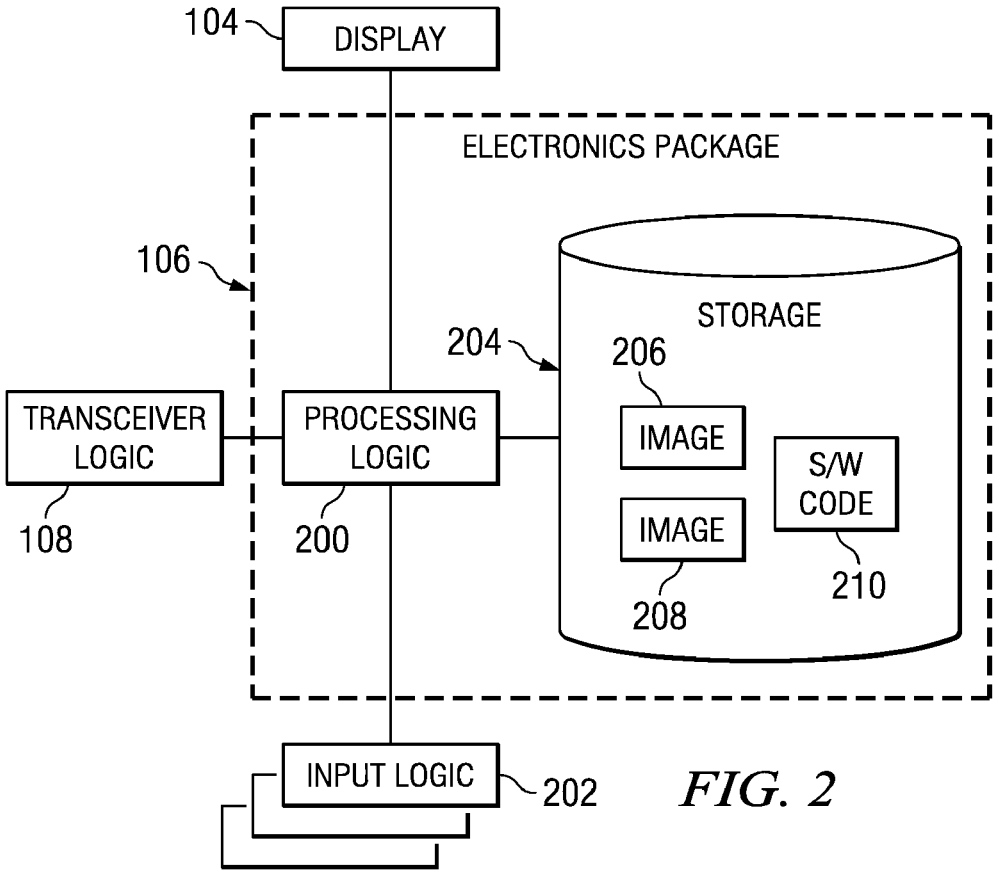
FIG. 2 shows a block diagram of at least some of the contents of the device of FIG. 1, in accordance with embodiments of the invention.

FIG. 2 shows an illustrative block diagram of at least some of the contents of the electronics package 106. The package 106 comprises a processing logic 200 coupled to a storage 204. The storage 204 comprises a computer-readable medium such as any suitable type or types of volatile memory (e.g., random access memory (RAM)), non-volatile memory (e.g., read-only memory (ROM)), hard drive, flash memory, etc., or combinations thereof. In preferred embodiments, the storage 204 comprises various types of memory. The various memories of storage 204 may be housed within a single unit or among multiple, discrete units. The storage 204 comprises an image 206, another image 208 and software code 210. By executing the software code 210, the processing logic 200 is caused to alpha-blend the images 206 and 208 as described below. The processing logic 200 also couples to the display 104, the transceiver logic 108, multiple input devices 202 (e.g., keys on the keypad 102, the microphone 114, the camera 116) and various other circuit logic (not specifically shown).

Figure 3A:
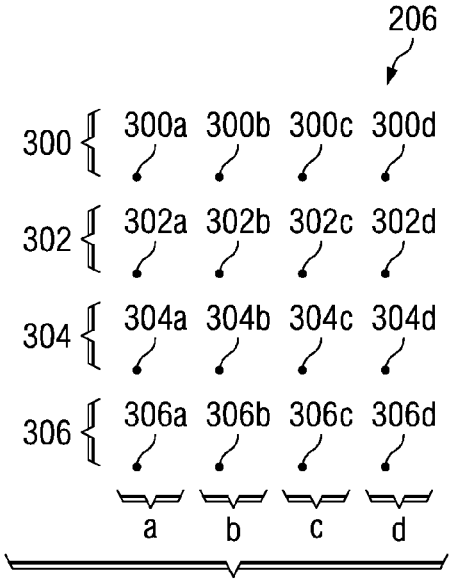
FIGS. 3*a* and 3*b* show pixel constellations of images stored in the device of FIG. 1, in accordance with embodiments of the invention.
Figure 3B:
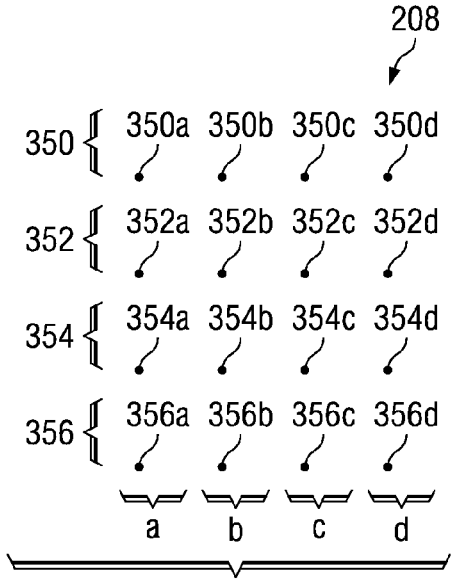

As previously explained, each image comprises a plurality of pixels. FIG. 3*a* shows a conceptual illustration of the pixels of the image 206. As shown, the image 206 comprises pixel rows 300, 302, 304 and 306 and pixel columns a, b, c and d. Thus, for example, the top-left pixel in the image 206 is referred to as "pixel 300*a*." Although only sixteen pixels are shown for the sake of clarity and brevity, images such as the image 206 may comprise any suitable number of pixels. FIG. 3*b* shows a conceptual illustration of the pixels of the image 208. As shown, the image 208 comprises pixel rows 350, 352, 354 and 356 and pixel columns a, b, c and d. Thus, for example, the top-left pixel in the image 208 is referred to as "pixel 350*a*." As with the image 206, although only sixteen pixels are shown to be associated with the image 208, images such as the image 208 may contain any suitable number of pixels. In accordance with various embodiments disclosed herein, pixels of the images 206 and 208 are alpha-blended to produce a result image in which one of the images 206, 208 is a background image and the other of the images 206, 208 is a "translucent" foreground image. Stated otherwise, after the alpha-blending of the images 206 and 208 is complete, a viewer is not only able to see the "translucent" foreground image, but is also able to see "through" the foreground image to a background image.

Figure 3C:
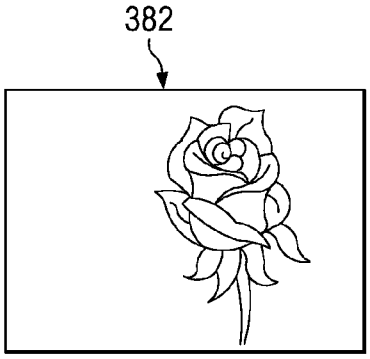
FIG. 3*e* shows an image that results from alpha-blending the images shown in FIGS. 3*c* and 3*d*, in accordance with embodiments of the invention.
Figure 3D:
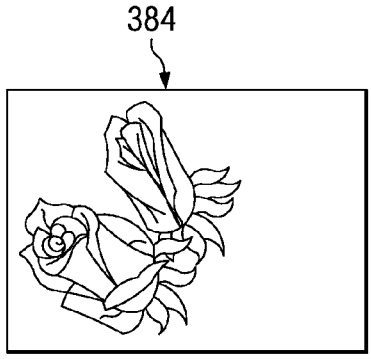
Figure 3E:
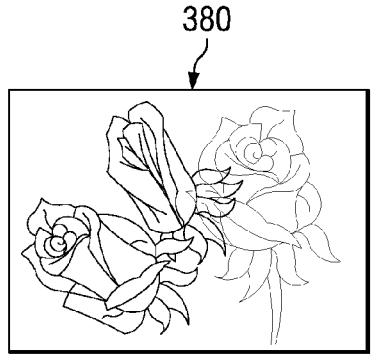

In some embodiments, the background image is not actually positioned behind the foreground image, nor is the foreground image actually translucent. Instead, the effect of translucency is achieved by blending the images 206 and 208 together and displaying the blended images as a single image. Referring to FIGS. 3*c*, 3*d* and 3*e*, FIG. 3*e* shows an image 380 that is generated by alpha-blending the image 382 of FIG. 3*c* with the image 384 of FIG. 3*d*. As shown in image 380, the foreground image 382 appears to be translucent, and the background image 384 appears to be positioned behind the foreground image 382 so that the image 384 is visible "through" the image 382.

Figure 4:
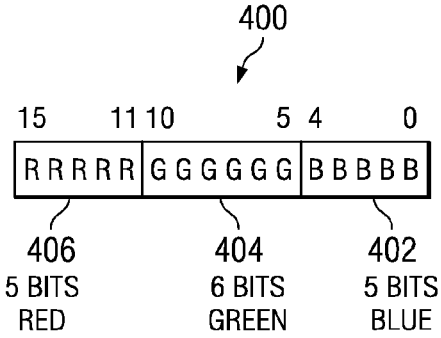
FIG. 4 shows a binary code associated with a pixel and comprising red, green and blue sub-codes, in accordance with preferred embodiments of the invention.

In at least one embodiment, each pixel (e.g., pixels in the images 206 and 208) has a color comprising red, green and blue (RGB) components. The color of each pixel is determined by the combined intensities of the red, green and blue components of that pixel. This RGB intensity information is encoded in a binary code associated with that pixel. The binary code may be of any suitable length, such as 8 bits, 10 bits, 12 bits, 16 bits, 24 bits, 32 bits, etc., but for purposes of this discussion, it is assumed that the binary codes are 16 bits in length. FIG. 4 shows an illustrative binary code 400 associated with a pixel. As shown, the binary code 400 comprises 16 bits. The 5 least significant bits comprise a sub-code 402 for the blue component of the pixel. This sub-code 402 indicates the intensity of the blue component of the pixel. Similarly, the 5 most significant bits of the binary code 400 comprise a sub-code 406 for the red component of the pixel. This sub-code 406 indicates the intensity of the red component of the pixel. Likewise, the 6 bits between the 5 most significant bits and the 5 least significant bits comprise a sub-code 404. The sub-code 404 indicates the intensity of the green component of the pixel. Together, the red component sub-code 402, the green component sub-code 404 and the blue component sub-code 406 form the binary code 400, which indicates the overall color of the pixel with which the code 400 is associated.

In accordance with embodiments of the invention, execution of the software code 210 causes the processing logic 200 to manipulate and combine the binary codes 400 of multiple pixels. Specifically, pairs of pixels from the images 206 and 208 are alpha-blended to produce new pixels, and each new pixel is used to replace one of the pixels of the images 206 or 208 that was used in the alpha-blending. For example, referring to FIGS. 3*a* and 3*b*, pixel 300*a* may be alpha-blended with pixel 300*b* to produce a new pixel. One of the pixels 300*a* or 300*b* then may be replaced with the new pixel. This alpha-blending process is repeated for some or all of the pixels in the images. In this way, the translucency effect mentioned above is achieved. A conceptual description of alpha-blending is now provided, followed by descriptions of at least some of the alpha-blending algorithms which fall within the scope of this disclosure.

Alpha-blending is termed "alpha-blending" because it involves the blending of two pixels according to a ratio "alpha." As mentioned, the blending is performed so that one image is made to appear "translucent." The translucent image may be in "front" of a background image, such that both the translucent image and the background image are visible. The degree of translucency of the translucent image (also called the "foreground" image) is determined by the ratio alpha. As alpha approaches 1.00, the foreground image becomes increasingly opaque. As alpha approaches 0.00, the foreground image becomes increasingly transparent. When alpha is between 0.00 and 1.00, the foreground image appears to have at least some degree of translucency. Graphical effects, such as "fading," can be created by repeatedly adjusting alpha within a short time frame.

The blending of two pixels may be performed according to an equation:

$$New_Pixel=(alpha(Pixel1))+((1-alpha)Pixel2)$$

where Pixel1 is associated with the image 206, Pixel2 is associated with the image 208, and New_Pixel is associated with the result image which includes image 206 as the foreground image and image 208 as the background image. This blending operation is performed for most or all pixels in the images 206 and 208. As alpha increases, the overall image (including both images 206 and 208) will show the foreground image 206 becoming increasingly opaque (e.g., easier to see) and will show the background image 208 becoming increasingly transparent (e.g., more difficult to see). As alpha decreases, the overall image will show the foreground image 206 becoming increasingly transparent and will show the background image 208 becoming increasingly opaque.

There are now described multiple algorithms in accordance with various embodiments of the invention. Each of the algorithms may be used to alpha-blend the pixels of multiple images. The scope of this disclosure is not limited to the precise algorithms disclosed herein. The algorithms may be adapted in any suitable way by, for example, a programmer. For instance, although the algorithms are described assuming an alpha ratio of 0.50, the algorithms may be adjusted as necessary for any suitable alpha ratio (e.g., 0.25, 0.75). Or, for instance, although the algorithms are described assuming the pixels of only two images are being blended, the algorithms may be adjusted as necessary for the pixels of any desired number of images to be blended. Below, each of multiple exemplary algorithms is first described using pseudocode, followed by an illustrative implementation of the algorithm in software code (e.g., in the "C" programming language).

One algorithm is disclosed in FIGS. 5*a* and 5*b*. In this algorithm, the pixels of the two images 206, 208 are alpha-blended. The pixels of the two images are blended on a pixel-by-pixel basis. For example, momentarily referring to FIGS. 3*a* and 3*b*, the algorithm comprises a loop (called a "column loop") in which it blends pixels 300*a* and 350*a*, then blends pixels 300*b* and 350*b*, followed by 300*c* and 350*c*, followed by 300*d* and 350*d*. The algorithm then begins blending the next row of pixels in each image. Specifically, the algorithm's column loop is used to blend pixels 302*a* and 352*a*, followed by 302*b* and 352*b*, and so on. The algorithm shifts from one row to the next using a larger loop (called a "row loop") inside which the column loop is embedded. In this way, the algorithm blends each pair of corresponding pixels in the images 206 and 208.

Each pair of corresponding pixels is blended using several steps. First, the red, green and blue sub-codes associated with one of the pixels are extracted from image 206. In particular, the 5-bit red sub-code, 6-bit green sub-code, and 5-bit blue sub-code are "stripped off" of the 16-bit binary code associated with that pixel. Next, the red, green and blue sub-codes associated with the other pixel are extracted from image 208. This extraction is performed in a manner similar to that used to extract the sub-codes of the pixel of image 206.

The two red sub-codes are summed together and divided by two (i.e., since the alpha ratio in this illustrative algorithm is 0.50). Similarly, the green sub-codes are summed together and divided by two, and the blue sub-codes are summed together and divided by two. The results of the blending of the red, green and blue sub-codes are concatenated to once again form a 16-bit binary code. This 16-bit binary code represents the color of the pixel that results from blending the two pixels of images 206 and 208.

Once the blended 16-bit concatenated binary code has been determined, the algorithm includes overwriting one of the 16-bit binary codes used in the alpha blending (i.e., the binary code of the pixel from image 206 or of the pixel from image 208) with the blended 16-bit binary code. Which one of the binary codes is overwritten with the new, blended binary code depends on how the images 206 and 208 are to be displayed. In some embodiments, the new, blended binary code overwrites the existing binary code of a foreground image. For instance, if the image 206 is to be the foreground image and the image 208 is to be the background image, the 16-binary code associated with the pixel of the image 206 is overwritten with the new, blended 16-bit binary code. The process is then repeated for the next pair of pixels in the images 206 and 208. Once each pixel pair has been blended and the resulting binary code has been written to the image 206 (or, in some embodiments, the image 208), when the image 206 is displayed, the image 206 will appear to be translucent. The image 208 appears to be "behind" the image 206, and is visible "through" the image 206, because the image 208 has been blended with the image 206. Thus, in some embodiments, the image 208 may not actually be positioned "behind" the image 206, but may appear to be positioned in this way because the image 206 contains a blend of the original image 206 and the image 208.

FIG. 5*a* shows a pseudocode of an alpha-blending algorithm 500 (e.g., included in software code 210). The algorithm 500 is used to blend the two images 206 and 208 with an alpha ratio of 0.50, but it may be adapted to suit any alpha ratio between 0.0 and 1.0. The algorithm 500 includes two loops. A first loop 502 is present so that the algorithm 500 may be performed for each pixel row of the images 206 and 208. The second loop 504, which is embedded within the first loop 502, is so that the algorithm 500 may be performed for each pixel column of the images 206 and 208. The body 505 of the algorithm 500 indicates the actions which are performed by the processing logic 200 during each iteration of the algorithm. For each iteration of the algorithm, RGB information is extracted from the image 206 (numeral 506). Similarly, for each iteration of the algorithm, RGB information is extracted from the image 208 (numeral 508). Referring briefly to FIG. 4, the RGB information extracted from the images 206 and 208 includes the red, green and blue sub-code information for each pixel in the images 206 and 208. The algorithm 500 also includes adding the red sub-codes of the images 206 and 208 to form a binary sum, and it also includes dividing the binary sum by two (since the alpha ratio is 0.50) by performing a right-shift of the binary sum (numeral 510). The same summation and shifting process is repeated for the green sub-codes (numeral 512) and the blue sub-codes (numeral 514). The red, green and blue binary sums are then concatenated to form a 16-bit binary code, and this 16-bit binary code is written to the pixel in image 206 that is being processed (numeral 516). Pointers which give access to pixel locations within the image matrix (e.g., as shown in FIGS. 3*a* and 3*b*) are adjusted between the first loop 502 and the second loop 504 (numeral 518) to point to the next row of the matrix for restarting the loop 504 on the next line of the image.

After the algorithm 500 is repeated for each pixel in the images 206 and 208, the end result includes a foreground image 206 where the "translucency" of the image 206 is at 50% (i.e., alpha is 0.50). Stated otherwise, when the foreground image 206 is displayed, it will appear to be equally as "visible" as the background image 208. The algorithm 500 may be adapted to perform similar techniques for any suitable alpha ratio (e.g., 0.25, 0.75).

FIG. 5*b* shows a software implementation (e.g., included in some embodiments of the software code 210) implementation of the algorithm 500. Referring to both FIGS. 5*a* and 5*b*, a command for the loop for rows (numeral 502) is shown in line 550. The row loop variable is ICnt1. The variable ICnt1 is initialized to 0. ICnt1 is incremented each time the row loop is executed. The row loop is executed as long as variable ICnt1 is less than the HEIGHT (in pixels) of the images 206 and 208. A command for the loop for columns (numeral 504) is shown in line 552. The column loop variable is ICnt2. The variable ICnt2 is initialized to 0. ICnt2 is incremented each time the column loop is executed. The column loop is executed as long as variable ICnt2 is less than the WIDTH (in pixels) of the images 206 and 208. Blending of some pixel pairs may be skipped in some embodiments.

The portion of the algorithm 500 represented by numeral 506 (FIG. 5*a*) is shown as lines 554, 556 and 558 in FIG. 5*b*. In line 554, variable Rdst is determined by obtaining the red component sub-code of the pixel in image 206 indicated by the values ICnt1 and ICnt2. The red component sub-code is extracted from the binary code of the pixel by applying the mask 0xF800 to the binary code, which forces the green and blue sub-codes to zero. Once obtained, the red component sub-code is right-shifted by 11 bits, so that any mathematical operations performed using the red component sub-code do not result in overflow errors.

In line 556, a similar process is repeated for the green sub-code. Specifically, variable Gdst is determined by obtaining the green component sub-code of the pixel in image 206 indicated by the values ICnt1 and ICnt2. The green component sub-code is extracted from the binary code of the pixel by applying the mask 0x07E0 to the binary code, which forces the red and blue sub-codes to zero. Once obtained, the green component sub-code is right-shifted by 5 bits, so that any mathematical operations performed using the green component sub-code do not result in overflow errors.

In line 558, a similar process is repeated for the blue sub-code. In particular, variable Bdst is determined by obtaining the blue component sub-code of the pixel in image 206 indicated by the values ICnt1 and ICnt2. The blue component sub-code is extracted from the binary code of the pixel by applying the mask 0x001F to the binary code, which forces the red and green sub-codes to zero. Once obtained, the blue component sub-code is not right-shifted since, as shown in FIG. 4, the blue component sub-code bits already constitute the least-significant bits of the binary code (i.e., the blue component sub-code bits are already right-shifted as much as possible). Steps similar to those performed in lines 554, 556 and 558 are performed for variables Rbld, Gbld and Bbld in lines 560, 562 and 564, respectively. The variables Rbld, Gbld and Bbld correspond to red, green and blue component sub-codes associated with the pixel of image 208 that is indicated by ICnt1, ICnt2.

The components of the algorithm 500 indicated by numerals 510, 512 and 514 are performed by code in lines 566, 568 and 570, respectively. Specifically, in line 566, the new value of variable Rdst is determined by summing Rbld and the current value of Rdst (e.g., by summing the red component sub-code of the pixel from image 206 with the red component sub-code of the pixel from image 208). The resulting sum is then right shifted by 1 bit, thereby causing the sum to be integer-divided by two. In this case, the sum is divided by 2 because the alpha ratio is 0.50. However, different divisions may be used in implementations where the alpha ratio is not 0.50. Similar processes are repeated in lines 568 and 570 for the green component sub-codes (obtained in lines 556 and 562) and the blue component sub-codes (obtained in lines 558 and 564).

The component of the algorithm 500 represented by numeral 516 is shown in lines 572, 574 and 576. In lines 572, 574 and 576, the newly determined RGB sub-codes Rdst, Gdst and Bdst are concatenated to form a 16-bit binary code. The concatenated 16-bit binary code is written to the pixel (of the image 206) which corresponds to the current values of ICnt1 and ICnt2. Specifically, in line 572, the red component sub-code Rdst is written to the 16-bit binary code of the pixel in image 206 that is associated with the values of ICnt1 and ICnt2. The sub-code is shifted to the left by 11 bits, because the red component sub-code should be positioned in the most significant bit space in the 16-bit binary code (as shown in FIG. 4). In line 574, the green component sub-code Gdst is written to the 16-bit binary code of the pixel in image 206 that is associated with the values of ICnt1 and ICnt2. The sub-code is shifted to the left by 5 bits, because the green component sub-code should be positioned immediately to the right of the red component sub-code as shown in FIG. 4. In line 576, the blue component sub-code Bdst is written to the 16-bit binary code of the pixel in image 206 that is associated with the values of ICnt1 and ICnt2. The sub-code does not need to be shifted, because the blue component sub-code should be positioned in the least significant bit space in the 16-bit binary code.

The component of the algorithm 500 represented by numeral 518 is shown in lines 578 and 580. In line 578, and in line 580, the first and second image pointers are adjusted to point to the next row within the image matrix to restart the loop 552.

There is now described another illustrative algorithm, in accordance with various preferred embodiments of the invention. This algorithm is disclosed in FIGS. 6*a* and 6*b*. In this algorithm, the pixels of the two images 206, 208 are alpha-blended. As with the first algorithm 500, in this algorithm, the pixels of the two images are blended on a pixel-by-pixel basis. However, in this algorithm, each pair of pixels preferably is blended using a single equation. Stated otherwise, the processing logic 200 is adapted to alpha-blend the pixels 206 and 208 without operating on each of the red, green and blue sub-codes individually. Stated in yet another way, the logic 200 is adapted to alpha-blend the pixels 206 and 208 using their respective binary codes while the binary codes are in concatenated form (i.e., the RGB sub-codes of a binary code are not separated from each other and are not operated on apart from each other). In this equation, a different pixel from each of images 206 and 208 is integer-divided by 2 (i.e., right-shifted by 1 bit). Masks are then applied on the resulting quotients to remove the least significant bits associated with the red and green sub-codes of each pixel, thereby producing modified quotients. The modified quotients are added to produce a first sum. The single equation also comprises applying a different mask to the binary codes of each of the two pixels and adding the resulting masked binary codes to form a second sum. The mask is applied to remove bits already operated on when the first sum was produced. The second sum is then integer-divided by 2 (i.e., right-shifted by 1 bit) to form a quotient. A mask is applied to the quotient to ensure that no bits were lost during the division. The masked quotient is then added to the first sum to produce a result of the single equation. The result of the single equation is stored to the binary code of the pixel of image 206 (or, in some embodiments, to the binary code of the pixel of image 208).

The equation is then repeated for the next pair of pixels in the images 206 and 208. Once each pixel pair has been blended and the resulting binary code has been written to the image 206 (or, in some embodiments, the image 208), when the image 206 is displayed, the image 206 will appear to be translucent.

FIG. 6*a* shows a pseudocode of this alpha-blending algorithm 600 (e.g., embedded in software code 210) in accordance with at least some preferred embodiments of the invention. As with the algorithm 500, the algorithm 600 is used to blend the two images 206 and 208 with an alpha ratio of 0.50, but it may be adapted to suit any alpha ratio between 0.0 and 1.0. The algorithm 600 includes two loops. A first loop 602 is present so that the algorithm 600 may be performed for each pixel row of the images 206 and 208. The second loop 604, which is embedded within the first loop 602, is present so that the algorithm 600 may be performed for each pixel column of the images 206 and 208. The body 606 of the algorithm 600 indicates the actions which are performed by the processing logic 200 in each iteration of the algorithm. In each iteration of the algorithm 600, a pixel of the image 206 is blended with a corresponding pixel in the image 208. In each iteration, the pixel in the image 206 that is being processed is modified in accordance with the result obtained by performing the computations shown in numeral 606.

In the computations, the 16-bit binary code of the pixel of image 208 is right-shifted by one bit (i.e., integer-divided by 2) and a mask is applied to the resulting right-shifted binary code. The mask is used to ensure that the least significant bits associated with the red and green sub-codes of the pixel's binary code are removed from those sub-codes. These operations are represented by the numeral 610. Also in the computations, the 16-bit binary code of the pixel of image 206 is right-shifted by one bit and a mask is applied to the resulting right-shifted binary code. This mask, which in some embodiments is the same mask used for the binary code of the pixel of image 208, is used to ensure that the least significant bits associated with the red and green sub-codes of the pixel's binary code are removed from those sub-codes. These operations are represented by numeral 612. In operation 614, a mask is applied to the pixel of image 208 in order to remove bits already operated on in the operations of numerals 610 and 612. In operation 616, the same mask is applied to the pixel of image 206. In operation 617, the results of operations 614 and 616 are summed. In operation 618, the result of operation 617 is right-shifted by 1 bit (i.e., integer-divided by 2). In operation 620, a mask is applied to the result of the operation 618. The mask is applied to ensure that no bits were lost during the division. The mask is used to ensure that the least significant bits associated with the red and green sub-codes of the pixel's binary code are removed from those sub-codes. The operation 620 recovers bits lost during operations 610 and 612.

FIG. 6*b* shows a software (e.g., software code 210) implementation of the algorithm 600 in accordance with at least some embodiments of the invention. Referring to both FIGS. 6*a* and 6*b*, a command for the loop for rows (numeral 602) is shown in line 650. The row loop variable is ICnt1. The variable ICnt1 is initialized to 0. ICnt1 is incremented each time the row loop is executed. The row loop is executed as long as variable ICnt1 is less than the HEIGHT (in pixels) of the images 206 and 208. A command for the loop for columns (numeral 604) is shown in line 652. The column loop variable is ICnt2. The variable ICnt2 is initialized to 0. ICnt2 is incremented each time the column loop is executed. The column loop is executed as long as variable ICnt2 is less than the WIDTH (in pixels) of the images 206 and 208.

The portion of the algorithm 600 represented by numeral 606 (FIG. 6*a*) is shown as numeral 654 in FIG. 6*b*. In numeral 654, the 16-bit binary code associated with the pixel of image 206 that corresponds to the current values of ICnt1 and ICnt2 is set equal to the result of operations indicated by numerals 660, 662, 664, 666, 668 and 670. In operation 660, which corresponds to operation 610 of FIG. 6*a*, the 16-bit binary code of the pixel of image 208 which corresponds to the current values of ICnt1 and ICnt2 is right shifted by 1 bit (i.e., integer-divided by 2). A mask of 0x7BEF is then applied to this right-shifted binary code in order to ensure that the least significant bits of the red and green sub-codes of the binary code are removed. In operation 662, which corresponds to operation 612 of FIG. 6*a*, the 16-bit binary code of the pixel of image 206 which corresponds to the current values of ICnt1 and ICnt2 is right-shifted by 1 bit (i.e., integer-divided by 2). A mask of 0x7BEF is then applied to this right-shifted binary code in order to ensure that the least significant bits of the red and green sub-codes of the binary code are removed. In operation 664, which corresponds to operation 614 of FIG. 6*a*, a mask of 0x0821 is applied to the 16-bit binary code of the pixel of image 208 which corresponds to the current values of ICnt1 and ICnt2. The mask of 0x0821 is applied to the binary code in order to remove the bits already operated on in operations 660 and 662. Similarly, in operation 666, which corresponds to operation 616 in FIG. 6*a*, a mask of 0x0821 is applied to the 16-bit binary code of the pixel of image 206 which corresponds to the current values of ICnt1 and ICnt2. In operation 667, the results of operations 664 and 666 are summed to produce a result, and in operation 668, this result is right-shifted by 1 bit (i.e., integer-divided by 2). In operation 670, the mask of 0x0821 is applied to the quotient resulting from operation 668 in order to ensure that no bits were lost during the division of operation 668.

Operations 656 and 658 correspond to the component 608 of the pseudocode in FIG. 6*a*. In operations 656 and 658, first and second image pointers are adjusted to point to the next row within the matrix to restart the loop 552 at the proper position.

An illustrative application of the software code 210 shown in FIG. 6*b* is now provided. Assume the pixel associated with image 206 has a 16-bit binary code and that the pixel associated with image 208 has a 16-bit binary code

0000100000100001 and that the pixel associated with image 208 has a 16-bit binary code

0000100000100001.

In operation 660, the pixel of image 208 is integer-divided by 2 (i.e., right-shifted by 1 bit) to produce

0000010000010000.

A mask 0x7BEF is applied to this result:

Result: 0000 0100 0001 0000

Mask: 01111011 11100000 where the bit groups "0111," "1011," "1110" and "0000" of the mask correspond to 7, B, E and F, respectively. The mask is applied using an AND operation, resulting in 0000 0000 0000 0000.

For purposes of this example, this result is referred to as "Sum 1." In operation 662, the 16-bit binary code of the pixel of image 206 is right-shifted by 1 bit to produce

0000010000010000.

A mask 0x7BEF is applied to this result:

| | |
|---|---|
| Result: | 0000 0100 0001 0000 |
| Mask: | 0111 1011 1110 0000 |

The mask is applied using an AND operation, resulting IN;

0000 0000 0000 0000.

For purposes of this example, this result is referred to as "Sum 2." Sum 1 and Sum 2 are added together to produce a third sum, referred to as Sum 3.

In operation 664, a mask 0x0821 is applied to the 16-bit binary code of pixel 208:

| | |
|---|---|
| Binary code: | 0000 1000 0010 0001 |
| Mask: | 0000 1000 0010 0001 |

The mask is applied using an AND operation, resulting in 0000 1000 0010 0001.

In operation 666, a mask 0x0821 is applied to the 16-bit binary code of pixel 206:

| | |
|---|---|
| Binary code: | 0000 1000 0010 0001 |
| Mask: | 0000 1000 0010 0001 |

The mask is applied using an AND operation, resulting in:

0000 1000 0010 0001.

In operation 667, the results of operations 664 and 666 are added together to form a Sum 4:

| | |
|---|---|
| Result of Operation 664: | 0000 1000 0010 0001 |
| Result of Operation 666: | 0000 1000 0010 0001 |
| Sum 4: | 0001 0000 0100 0010. |

In operation 668, Sum 4 is integer-divided by 2 to produce a quotient:

Quotient: 0000 1000 0010 0001.

In operation 670, a mask of 0x0821 is applied to the quotient:

| | |
|---|---|
| Quotient: | 0000 1000 0010 0001 |
| Mask: | 0000 1000 0010 0001 |
| Result: | 0000 1000 0010 0001. |

The result of operation 670 is added to the result of operation 662 (i.e., Sum 3), resulting in:

| | |
|---|---|
| Sum 3: | 0000 0000 0000 0000 |
| Result: | 0000 1000 0010 0001 |
| Sum 5: | 0000 1000 0010 0001, |

where Sum 5 is the result of the operation of numeral 654. The binary code of Sum 5 is used to replace the 16-bit binary code of the pixel of image 206. The next pair of pixels is then processed.

In at least some preferred embodiments, the algorithm 600 may be adjusted to increase efficiency. In particular, the masks of the algorithm 600 may be adjusted so that systems with wider data buses (e.g., 32-bit) may be used efficiently. FIG. 7*a* shows a pseudocode of another alpha-blending algorithm 700 (i.e., embedded in software code 210) in accordance with at least some preferred embodiments of the invention. The algorithm 700 is used to blend the two images 206 and 208 with an alpha ratio of 0.50, but it may be adapted to suit any alpha ratio between 0.0 and 1.0. The algorithm 700 includes two loops. A first loop 702 is present so that the algorithm 700 may be performed for each pixel row of the images 206 and 208. The second loop 704, which is embedded within the first loop 702, is present so that the algorithm 700 may be performed for each pixel column of the images 206 and 208. The body 706 of the algorithm 700 indicates the actions which are performed by the processing logic 200 in each iteration of the algorithm. In each iteration of the algorithm 700, two pixels of the image 206 are blended with corresponding pixels in the image 208. In each iteration, the pixels in the image 206 that are being processed are modified in accordance with the result obtained by performing the computations shown in numeral 706.

In the computations 706, the 32-bit binary code of the pixel of image 208 is right-shifted by one bit (i.e., integer-divided by 2) and a mask is applied to the resulting right-shifted binary code. The mask is used to ensure that the least-significant bits of the red, green and blue sub-codes are removed from those sub-codes. The mask is twice as large as that indicated by numeral 610 in FIG. 6*a*, since the binary code is no longer 16 bits but is 32 bits. These operations are represented by numeral 710. Also in the computations 706, the 16-bit binary code of the pixel of image 206 is right-shifted by one bit and a mask is applied to the resulting right-shifted binary code. This mask, which in some embodiments is the same mask used for the binary code of the pixel of image 208, is used to ensure that the least-significant bits of the red, green and blue sub-codes are removed from those sub-codes. These operations are represented by numeral 712. In operation 714, a mask is applied to the pixel of image 208 in order to remove bits already operated on in operations 710 and 712. In operation 716, the same mask is applied to the pixel of image 206. In operation 717, the results of operations 714 and 716 are summed. In operation 718, the result of operation 717 is right-shifted by 1 bit (i.e., integer-divided by 2). In operation 720, a mask is applied to the result of operation 718 in order to ensure that the least significant bits associated with the red, green and blue sub-codes of the pixel's binary code are removed from those sub-codes. Operation 720 recovers bits lost during operations 710 and 712.

FIG. 7*b* shows a software (e.g., included in at least some embodiments of the software code 210) implementation of the algorithm 700 in accordance with at least some embodiments of the invention. Referring to both FIGS. 7*a* and 7*b*, a command for the loop for rows (numeral 702) is shown in line 750. The row loop variable is ICnt1. The variable ICnt1 is initialized to 0. ICnt1 is incremented each time the row loop is executed. The row loop is executed as long as variable ICnt1 is less than the HEIGHT (in pixels) of the images 206 and 208. A command for the loop for columns (numeral 704) is shown in line 752. The column loop variable is ICnt2. The variable ICnt2 is initialized to 0. ICnt2 is incremented each time the column loop is executed. The column loop is executed as long as variable ICnt2 is less than the WIDTH/2 (in pixels) of the images 206 and 208.

The portion of the algorithm 700 represented by numeral 706 (FIG. 7*a*) is shown as numeral 754 in FIG. 7*b*. In numeral 754, the 16-bit binary code associated with the pixel of image 206 that corresponds to the current values of ICnt1 and ICnt2 is set equal to the operations indicated by numerals 760, 762, 764, 766, 768 and 770. In operation 760, which corresponds to operation 710 of FIG. 7*a*, the 16-bit binary code of the pixel of image 208 which corresponds to the current values of ICnt1 and ICnt2 is right shifted by 1 bit (i.e., integer-divided by 2). A mask of 0x7BEF7BEF is then applied to this right-shifted binary code in order to ensure that the least-significant bits of the red, green and blue sub-codes of the binary code are removed. In operation 762, which corresponds to operation 712 of FIG. 7*a*, the 16-bit binary code of the pixel of image 206 which corresponds to the current values of ICnt1 and ICnt2 is right-shifted by 1 bit (i.e., integer-divided by 2). A mask of 0x7BEF7BEF is then applied to this right-shifted binary code in order to ensure that the least-significant bits of the red, green and blue sub-codes of the binary code are removed. In operation 764, which corresponds to operation 714 of FIG. 7*a*, a mask of 0x08210821 is applied to the 16-bit binary code of the pixel of image 208 which corresponds to the current values of ICnt1 and ICnt2. The mask of 0x08210821 is applied to the binary code in order to ensure that bits already operated on in operations 760 and 762 are removed. Similarly, in operation 766, which corresponds to operation 716 in FIG. 7*a*, a mask of 0x08210821 is applied to the 16-bit binary code of the pixel of image 206 which corresponds to the current values of ICnt1 and ICnt2. In operation 767, the results of operations 764 and 766 are summed to produce a result, and in operation 768, this result is right-shifted by 1 bit (i.e., integer-divided by 2). In operation 770, a mask of 0x08210821 is applied to the quotient resulting from operation 768 in order to ensure that the least significant bits associated with the red, green and blue sub-codes of the pixel's binary code are removed from those sub-codes. As previously mentioned, each of the masks (e.g., 0x7BEF7BEF, 0x08210821) used in the algorithm 700 is twice as large as a corresponding mask used in algorithm 600.

Operations 756 and 758 correspond to the component 708 of the pseudocode in FIG. 7*a*. In operation 756 and 758, first and second image pointers are adjusted to point to the next row within the image matrix to restart loop 552.

By executing any of the algorithms, the processing logic 200 alpha-blends pixels in the images 206 and 208 that corresponds to each other. This alpha-blending produces a result image in which the image 206 appears to be a "translucent" image set in "front" of the image 208 (or vice-versa). Also, the algorithms 500, 600 and 700, as well as the various embodiments of software code 210, have been disclosed herein assuming that the alpha ratio is 0.50. However, the scope of this disclosure is not limited to any specific alpha ratio. The various algorithms and software code may be adapted to perform alpha-blending operations for any suitable alpha ratio(s).

Figure 8:
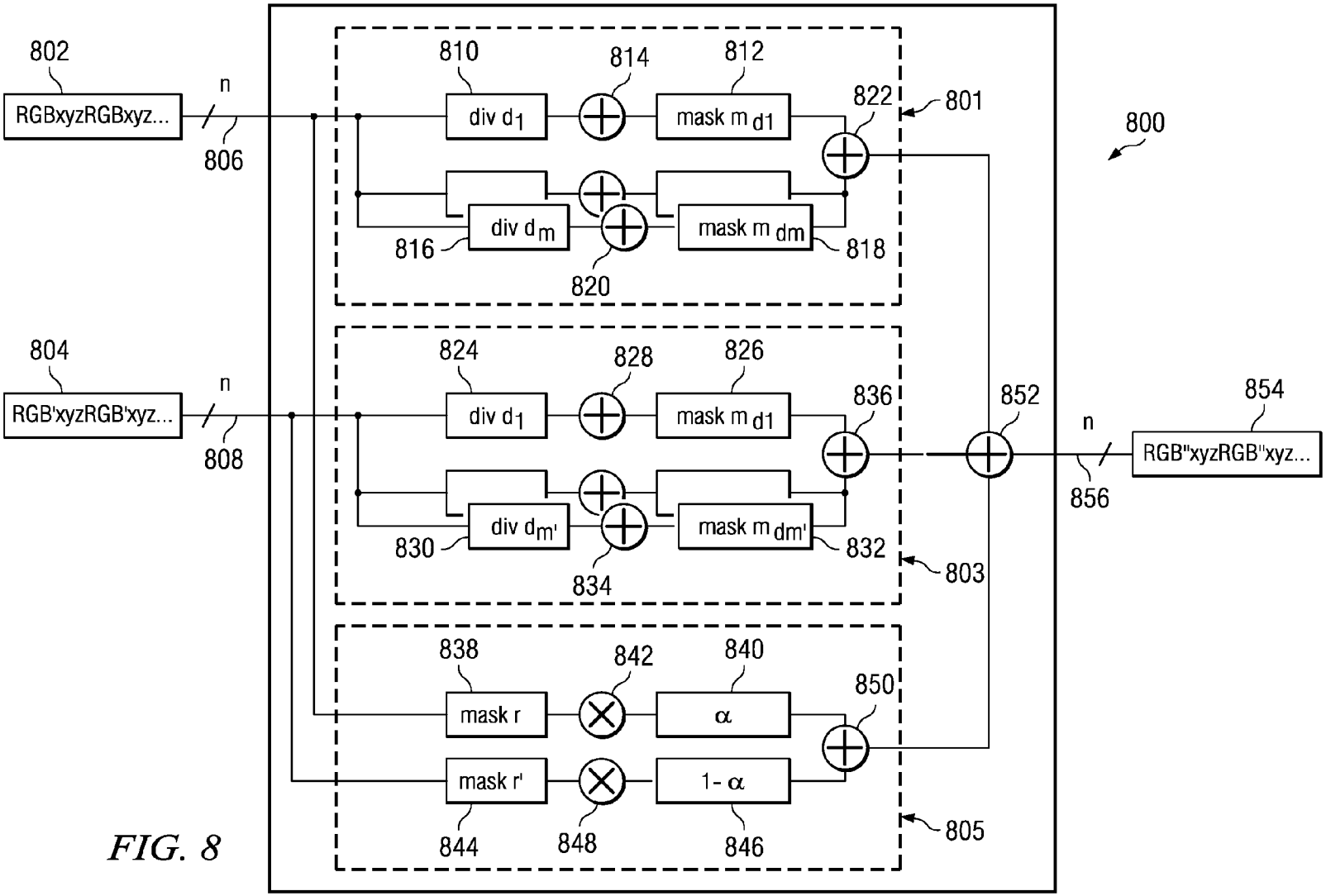
FIG. 8 shows a block diagram of an algorithm which may be implemented in hardware or software, in accordance with preferred embodiments of the invention.

FIG. 8 shows a conceptual block diagram of the implementation of an algorithm 800 which may be used to alpha-blend pixels having binary codes of any suitable length, using any suitable alpha ratio, and using any suitable data bus width. In some embodiments, the algorithm 800 may be implemented in software code, as described above. In some embodiments, the algorithm 800 may be implemented in hardware logic. For example, various gates, control logic, etc. of the electronics package 106 (shown in FIGS. 1 and 2) may be used to implement the algorithm 800. The algorithm 800 comprises components 801, 803 and 805. These components are used to alpha-blend the binary codes 802 and 804. The codes 802 and 804 may have any suitable widths. As shown on buses 806 and 808, the buses are n bits wide, meaning that the binary codes 802 and 804 may have maximum lengths of n.

The binary code 802 is provided to components 801 and 805. In component 801, the binary code 802 is divided (e.g., by 2, by 4; numeral 810). As indicated by numeral 814, the quotient resulting from the division is masked by a mask 812. In cases where multiple divisions may be performed (e.g., if alpha is 0.75), the additional divisions may be performed indicated by numeral 816, and the resulting quotients may be masked (numeral 818) as indicated by numeral 820. The masked quotients of numerals 812 and 818 are combined (numeral 822). For example, if alpha is 0.75, components 810, 812 and 814 may be used to obtain a binary value that is 0.25 of the binary code 802 (e.g., by right-shifting twice), and the components 816, 818 and 820 may be used to obtain a binary value that is 0.50 of the binary code 802 (e.g., by right-shifting once). The two binary values may be added at numeral 822 to form a binary value that is 0.75 of the binary code 802. In component 805, a mask r (numeral 838) is added to the binary code 802, followed by a multiplication (numeral 842) by the value of alpha (840). As previously mentioned, any suitable value of alpha may be used.

The binary code 804 is provided to components 803 and 805. In component 803, the binary code 804 is divided (e.g., by 2, by 4; numeral 824). As indicated by numeral 842, the quotient resulting from the division is masked by a mask 826. In cases where multiple divisions may be performed (e.g., if alpha is 0.75), the additional divisions may be performed as indicated by numeral 830, and the resulting quotients may be masked (numeral 832) as indicated by numeral 834. The masked quotients of numerals 826 and 832 are combined (numeral 836). In component 805, a mask r' (numeral 844) is added to the binary code 804, followed by a multiplication (numeral 848) by the value of (1−alpha) (numeral 846).

The results of operations 822, 836 and 850 are then combined as indicated by numeral 852. The resulting n-bit binary code (numeral 854) is output on bus 856. The binary code 854 may be used to overwrite, for example, the n-bit binary code 802. In alternative embodiments, the binary code 854 may be used to overwrite the n-bit binary code 804.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A system, comprising:

storage comprising a first graphical pixel and a second graphical pixel, each of the first and second graphical pixels associated with binary codes having red, green and blue sub-codes; and processing logic coupled to the storage and adapted to alpha-blend the first and second graphical pixels to produce a blended pixel, the processing logic performs said alpha-blend using the binary codes having red, green and blue sub-codes in concatenated form without operating on the sub-codes individually;

wherein the processing logic is adapted to alpha-blend the first and second graphical pixels by right-shifting and applying a first mask to each of said binary codes to produce a first result; and wherein the processing logic is adapted to: a) alpha-blend the first and second graphical pixels by applying a second mask to each of said binary codes to produce masked binary codes, b) summing the masked binary codes to produce a sum, and c) right-shifting the sum to produce a modified sum.

2. The system of claim 1, wherein the system comprises a mobile communication device.

3. The system of claim 1, wherein the processing logic is adapted to alpha-blend the first and second graphical pixels by applying a third mask to the modified sum to produce a second result, and adding the first result to the second result to produce a third result, the third result associated with said blended pixel.

4. The system of claim 1, wherein the first mask is used to remove least-significant bits associated with said sub-codes from said sub-codes.

5. The system of claim 1, wherein said first mask comprises a mask selected from the group consisting of 0x7BEF and 0x7BEF7BEF.

6. The system of claim 1, wherein the processing logic is adapted to alpha-blend said pixels by right-shifting the binary codes once to produce a second result, right-shifting the binary codes twice to produce a third result, and summing the second and third results to produce a fourth result, said fourth result associated with said first result.

7. The system of claim 1, wherein the processing logic is adapted to alpha-blend the first and second graphical pixels using the first and second masks, wherein the first mask is used to remove bits previously operated on and the second mask is used to remove least-significant bits associated with said sub-codes from said sub-codes.

8. The system of claim 7, wherein each of the first and second masks comprises a mask selected from the group consisting of 0x0821 and 0x08210821.

9. The system of claim 1, wherein said binary codes have lengths selected from the group consisting of 8-bits, 16-bits and 32-bits.

10. The system of claim 1, wherein the processing logic overwrites one of said first and second graphical pixels with said blended pixel.

11. A non-transitory computer-readable medium containing software that, when executed by a processor, causes the processor to:

obtain a first binary code associated with a first graphical pixel and a second binary code associated with a second graphical pixel, each of the binary codes comprising multiple sub-codes;

alpha-blend the first and second binary codes to produce a third binary code, said alpha-blend performed without individually alpha-blending sub-codes that correspond to each other;

said alpha-blend further performed wherein:

a) said first binary code does not include a concatenated alpha blend value;

b) said second binary code does not include a concatenated alpha blend value;

wherein an algorithm to adjust a ratio of said alpha-blend is adjustable; and store said third binary code;

wherein the processor is adapted to alpha-blend the first and second graphical pixels by right-shifting and applying a first mask to the first and second binary codes to produce a first result; and wherein the processor is adapted to: a) alpha-blend the first and second graphical pixels by applying a second mask to the first and second binary codes to produce masked binary codes, b) summing the masked binary codes to produce a sum, and c) right-shifting the sum to produce a modified sum.

12. The computer-readable medium of claim 11, wherein the computer-readable medium comprises a memory stored in a mobile communication device.

13. The computer-readable medium of claim 11, wherein the processor is caused to alpha-blend the first and second binary codes by right-shifting and applying a mask to each of said binary codes to produce a result.

14. The computer-readable medium of claim 11, wherein the processor is caused to alpha-blend the binary codes by right-shifting the binary codes once to produce a first result, right-shifting the binary codes twice to produce a second result, and summing the first and second results to produce a third result, the third result associated with said third binary code.

15. The computer-readable medium of claim 11, wherein the processor is caused to alpha-blend said binary codes using first and second masks, wherein the first mask is used to remove bits previously operated on and the second mask is used to ensure that no bits are lost while performing an integer-division on said binary codes.

16. The computer-readable medium of claim 11, wherein the binary codes have lengths selected from the group consisting of 8 bits, 16 bits and 32 bits.

17. A method that executes on a processor, comprising:

obtaining a first binary code and a second binary code, each of said binary codes comprising sub-codes associated with different colors, each of the sub-codes corresponds to another one of the sub-codes;

alpha-blending the first and second binary codes to produce a first result, said alpha-blending performed without operating individually on pairs of sub-codes which correspond to each other; and overwriting at least one of the first and second binary codes with the first result, wherein alpha-blending the first and second binary codes comprises right-shifting and applying a first mask to each of the binary codes to produce the first result; and wherein alpha-blending comprises: a) applying a second mask to each of said binary codes to produce masked binary codes, b) summing the masked binary codes to produce a sum, and c) right-shifting the sum to produce a modified sum, said alpha-blending occurring on said processor.

18. The method of claim 17, wherein the first and second binary codes are stored on a mobile communication device.

19. The method of claim 17, wherein alpha-blending comprises applying a third mask to the modified sum to produce a second result, and adding the first result to the second result to produce a third result, the third result associated with said first result.

20. The method of claim 17, wherein alpha-blending said binary codes comprises right-shifting the binary codes once to produce a second result, right-shifting the binary codes twice to produce a third result, and summing the second and third results to produce a fourth result, the fourth result associated with said first result.

* * * * *